US006449802B2

(12) United States Patent
Maeda

(10) Patent No.: US 6,449,802 B2
(45) Date of Patent: Sep. 17, 2002

(54) HINGE MEMBER

(75) Inventor: Shuji Maeda, Tokyo (JP)

(73) Assignee: Jamco Corporation, Tokyo (JP)

( * ) Notice: Subject to any disclaimer, the term of this patent is extended or adjusted under 35 U.S.C. 154(b) by 0 days.

(21) Appl. No.: 09/752,691

(22) Filed: Jan. 3, 2001

(30) Foreign Application Priority Data

Jan. 5, 2000 (JP) ..... 2000-005239

(51) Int. Cl.[7] ..... E05D 5/06; E05D 11/00

(52) U.S. Cl. ..... 16/389; 16/250; 16/387; 16/225; 49/383

(58) Field of Search ..... 16/389, 382, 250, 16/225, DIG. 13, 387; 160/40; 49/383, 303, 486, 475

(56) References Cited

U.S. PATENT DOCUMENTS 929,615 A * 7/1909 Madden ..... 16/252
1,904,120 A * 4/1933 Bommer ..... 16/252
3,911,633 A * 10/1975 Bamberger ..... 49/71
4,064,595 A * 12/1977 Leaver ..... 16/234
4,186,460 A * 2/1980 Artman ..... 16/274
4,807,397 A * 2/1989 Doan ..... 49/383
4,864,688 A * 9/1989 Gerber ..... 16/261
5,117,587 A * 6/1992 Doan ..... 49/383
5,220,708 A * 6/1993 Lucas et al. ..... 16/225
5,448,799 A * 9/1995 Stein, Jr. ..... 16/225
5,450,694 A * 9/1995 Goranson et al. ..... 16/225
5,666,695 A * 9/1997 Jegers et al. ..... 16/380

* cited by examiner

*Primary Examiner*—Chuck Y. Mah
(74) *Attorney, Agent, or Firm*—Armstrong, Westerman & Hattori, LLP

(57) ABSTRACT

A hinge member 50 of the present invention for rotatably mounting a moving member (door) 10 to a fixed member (opening in a wall member) 11 includes a support plate 51 provided with a mounting means for mounting to the fixed member 11, and a hinge flange 53 provided with a mounting means for mounting to the moving member. The support plate 51 and the hinge flange 53 are rotatably connected so as to pivot around a hinge pin 55. The hinge flange 53 has a first hinge flange 53A connected to the hinge pin 55, and a second hinge flange 53B provided with a sealing member 70 made of a flexible material, and a mounting means 533 for mounting to the moving member 10, the second hinge flange 53B is provided in right angle to the first hinge flange 53A, the first hinge flange 53A forms a gap between the fixed member 11 and the moving member 10, and the sealing member has the composition of sealing the gap.

2 Claims, 3 Drawing Sheets

HINGE MEMBER

FIELD OF THE INVENTION

The present invention relates to a hinge mechanism used as a support member for a rotatable moving member, such as a door and the like.

DESCRIPTION OF THE RELATED ART

The hinge member used as a support member for a rotatable door is formed so that a gap does not exist between the door opening and the hinge member when the door is closed, so there was a drawback that a finger might be caught between the door opening and the hinge member during operation of the door.

SUMMARY OF THE INVENTION

The present invention provides a hinge member having a guard mechanism by providing a shock absorber between a door opening, which is a fixing member, and a door, which is a moving body.

A hinge member of the present invention for rotatably mounting a moving member to a fixed member includes a support plate provided with a mounting means for mounting to the fixed member, and a hinge flange provided with a mounting means for mounting to the moving member. The support plate and the hinge flange are rotatably connected so as to pivot around a hinge pin.

The hinge flange is provided with a first hinge flange connected to the hinge pin, and a second hinge flange provided with a mounting means for mounting to the moving member, wherein the second hinge flange is provided in right angle to the first flange.

The first hinge flange forms a gap between the fixed member and the moving member.

Also, the second hinge flange is equipped with a sealing member made of a flexible material, and a mounting means for mounting to the moving member. The sealing member has a length size larger than the length size of the first hinge flange, and has the composition of sealing the gap between the fixed member and the moving member.

DETAILED DESCRIPTION OF PREFERRED EMBODIMENTS

The embodiment of the present invention will now be explained with reference to the drawings. In the embodiment, the fixed member indicates a structure such as a toilet unit or a telephone booth, and the moving body indicates a door provided to the entrance of the structure.

Figure 1:
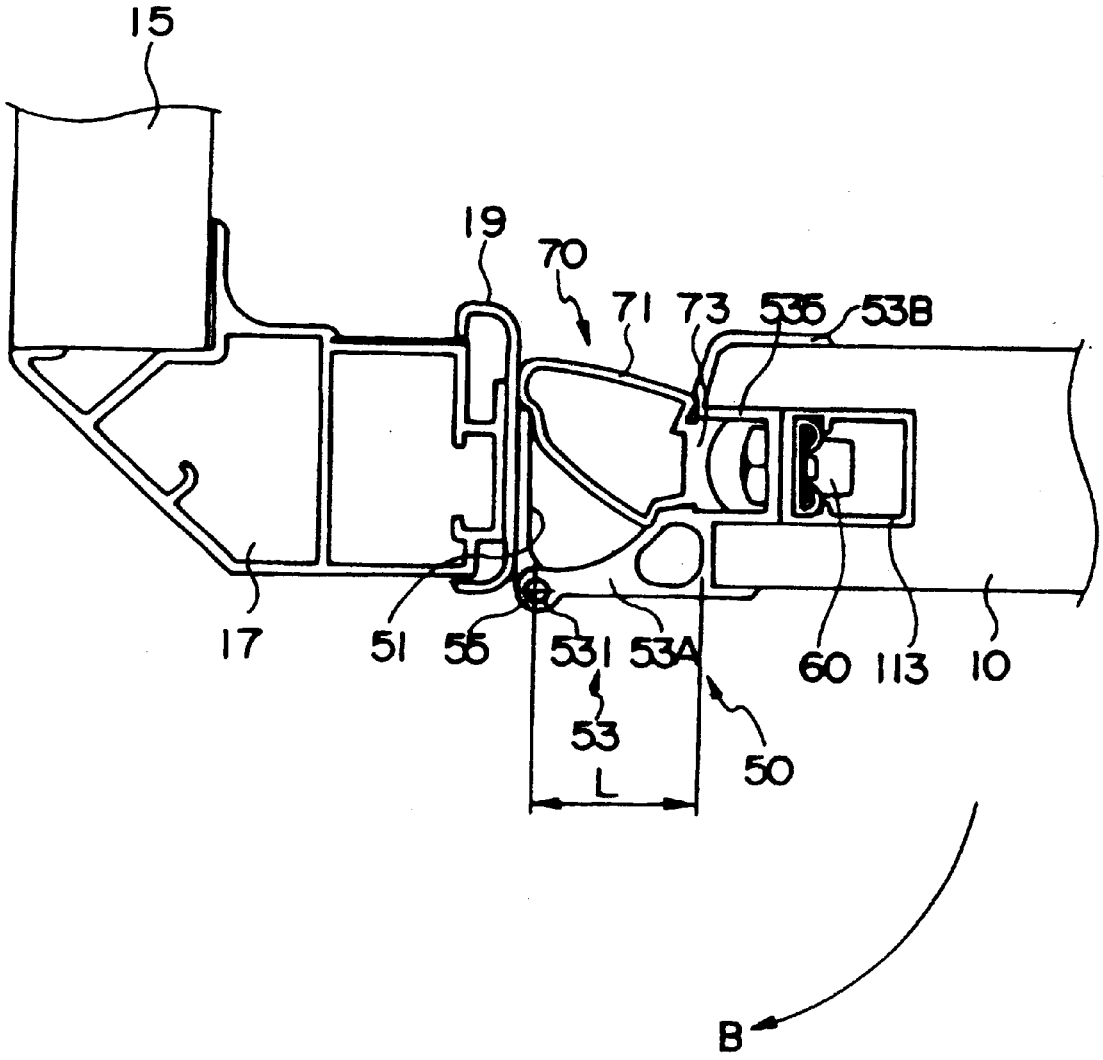
FIG. 1 is a cross-sectional view taken along line A—A in FIG. 3.
Figure 2:
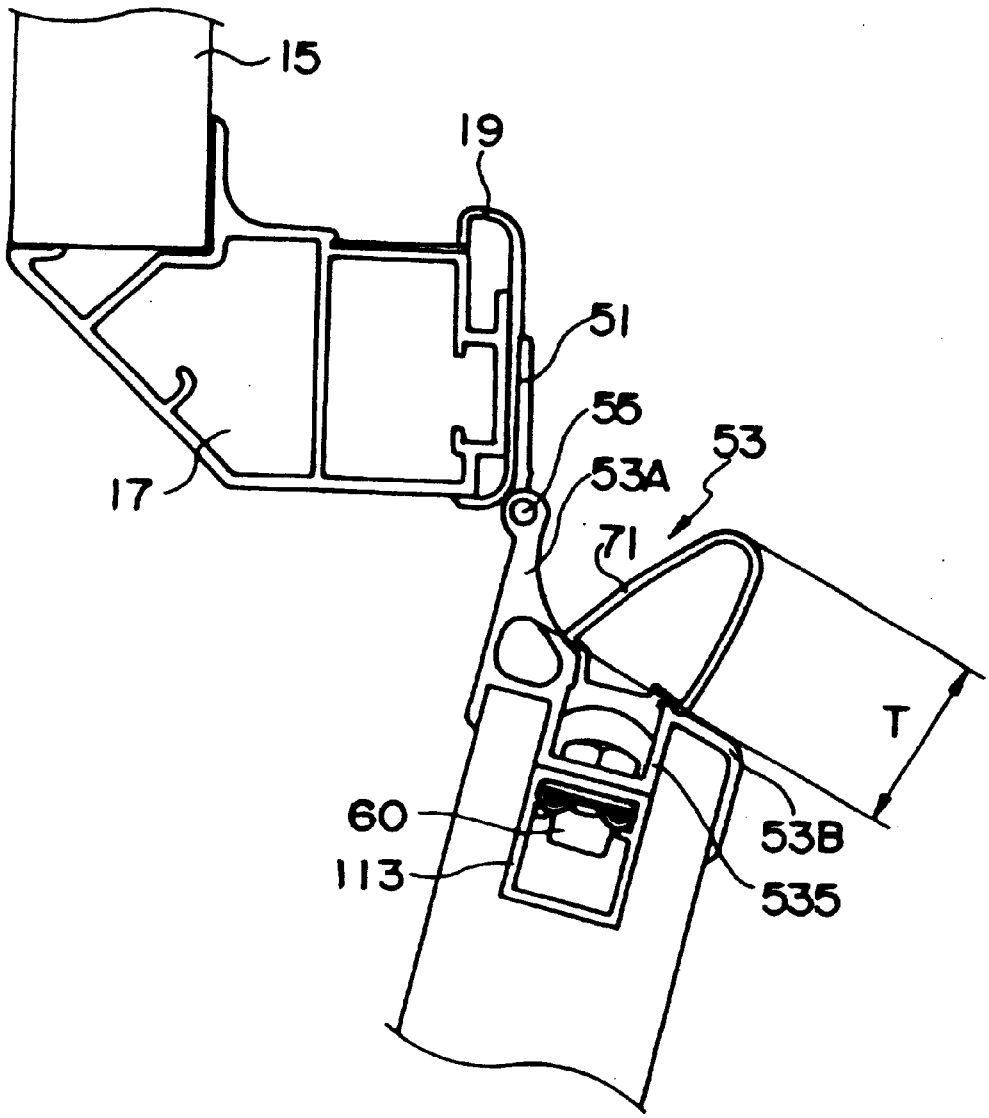
FIG. 2 is an explanatory cross-sectional view of the portion where hinge member is provided during opened condition of a door.
Figure 3:
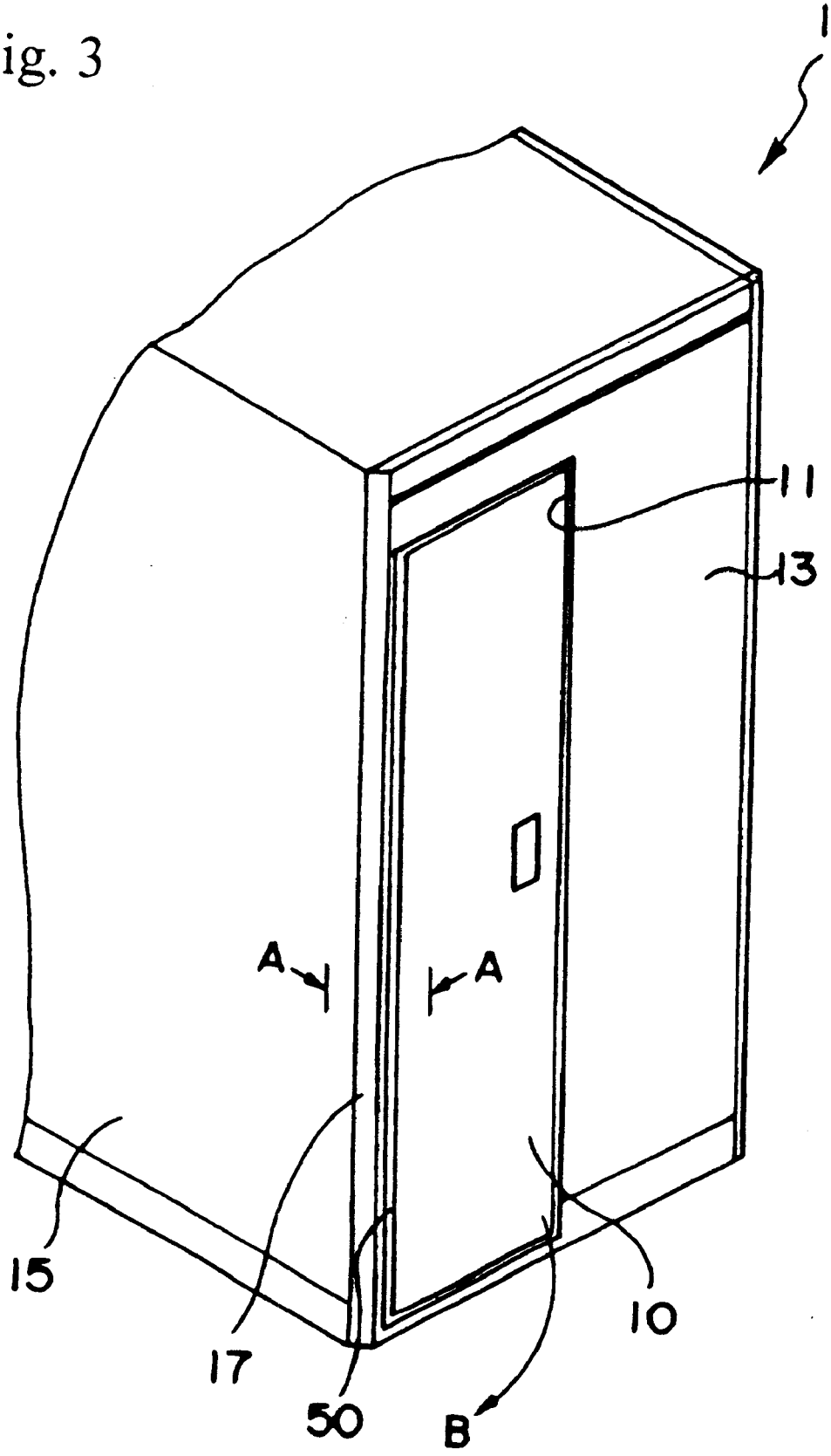
FIG. 3 is a perspective view of a structure (unit).

FIG. 1 shows a cross-sectional view of a portion using the hinge member according to the present invention taken along line A—A in FIG. 3, FIG. 2 is an explanatory cross-sectional view showing a condition where the door is opened, and FIG. 3 is a perspective view of a unit utilizing a hinge member of the present invention.

FIG. 3 shows a unit 1 wherein a door is fixed to a door opening 11 using a hinge member 50 according to the present invention.

The door opening 11 is formed to a wall member 13 of the unit 1. A door 10 is fixed rotatably to the opening 11. The door 10 is mounted to a corner panel 17 provided to the end edge of a side wall panel 15 through the hinge member 50.

The hinge member 50 is provided with a support plate 51 for mounting to the corner panel 17 of the side wall panel 15, a hinge flange 53 for connecting to the door 10 side, and a pin 55 for rotatably connecting the support plate 51 and the hinge flange 53.

The support plate 51 is a plate formed at one end with an insertion hole for inserting the pin 55, and is fixed to a corner channel 19 for covering the end edge of the corner panel 17. The corner channel 19 is comprised of a plate made of metal.

The hinge flange 53 has a first hinge flange 53A having the longitudinal length size as a length size L, and a second hinge flange 53B connected to the first hinge flange 53A.

The first hinge flange 53A is formed at one end with an insertion hole 531 for inserting the pin 55.

The second hinge flange 53B forms a mounting portion 533 for mounting to the door 10. The mounting portion 533 for mounting to the door 10 is fixed to a supporting portion 113 provided to the end surface of the door 10 with a fixing member 60.

The supporting portion 113 formed to the end surface of the door 10 is a closed cross-sectional member fitted to a concave groove formed within the thickness of the end surface of the door 10. The mounting portion 533 of the second hinge flange 53B has a cross-sectionally U-shaped fixing portion 535 fitted to the concave groove of the door 10, and the second hinge flange 53B is mounted to the end edge of the door 10 by matching the bottom of the fitting portion 535 to the supporting portion 113 and fixing the same by the fixing member 60.

By adopting such a composition, the door 10 is mounted to the corner channel 17 with a gap approximately the size of the length size L of the first hinge flange 53A, and rotates in the direction of arrow B centering around the hinge pin 55.

Also, the hinge member 50 of the present invention mounts the sealing member 70 within the U-shaped fitting portion 535 of the second hinge flange 53B.

The sealing member 70 is composed by connecting a hollow convex portion 71 formed of elastic material made of synthetic resin and the like having flexibility, and a compressed portion 73 for fitting and compressing the fitting portion 535.

The length size T of the ejecting hollow convex portion 71 of the sealing member 70 has a length size larger than the gap between the end edge of the door 10 and the corner panel 17, that is, the length size L of the first hinge flange 53A (size L<size T). The hollow convex portion 71 of the sealing member 70 corresponds to the external force by bending, and returns to the original shape when freed from the external force.

The operation of the hinge member 50 thus composed will now be explained.

The door 10 is mounted to the wall member such as the side wall panel 15 and the like so as to rotate from closed condition as is shown in FIG. 1 to the opened condition as is shown in FIG. 2 using the hinge pin 55 as the rotation axis.

Under the closed condition, the door 10 is mounted to the corner panel 17 with a gap the size of length size L of the first hinge flange 53A. The sealing member 70 is provided to the inner side of the gap portion. The inner side of the unit 1 is sealed, when the tip of the hollow convex portion 71 of the sealing member 70 bends by coming into contact with the corner channel 19 and sealing the gap between the door 10 and the corner panel 17. With the sealing member 70, air and light inside the room does not leak to the exterior. Also, with the gap corresponding to the size of the first hinge flange 53A existing between the door 10 and the corner panel 17, fear of injuring the user by pinching a finger and the like during operation of the door 10 could be eliminated. Moreover, when a hand, clothing and the like comes into contact with the hinge portion, such hand, clothing and the like will not be caught in the gap between the door 10 and the corner panel 17 with the existence of the sealing member 70.

The present invention enables to eliminate the fear of a finger, an object or the like being caught in the hinge portion during operation of a moving body such as a door for entrance to structures such as a toiletry unit, a telephone booth and the like, and therefore, improvement in safety is achieved.

I claimed:

1. A hinge member for rotatably mounting a moving member to a fixed member, including:

a support plate mounted to said fixed member; and a hinge flange mounted to said moving member, wherein:

said support plate and said hinge flange are rotatably connected so as to pivot around a hinge pin;

said hinge flange is provided with a first hinge flange connected to said hinge pin, and a second hinge flange mounting said hinge flange to said moving member;

a length size of said first hinge flange defines a gap between said fixed member and said moving member; and said second hinge flange is provided in right angle to said first hinge flange, said second hinge flange including a sealing member having a length size larger than the length size of said first hinge flange, said sealing member being mounted on the second hinge flange so as to seal said gap between said fixed member and said moving member.

2. A hinge member according to claim 1, wherein said second hinge flange further includes mounting means for mounting to said moving member.

* * * * *